US005851245A

United States Patent [19]

Moriyama et al.

[11] Patent Number: 5,851,245

[45] Date of Patent: Dec. 22, 1998

[54] METHOD FOR PRODUCING SUPERHEAVY OIL EMULSION FUEL AND FUEL PRODUCED THEREBY

[75] Inventors: Noboru Moriyama, Wakayama; Akio Hiraki; Toshimitsu Ichinose, both of Nagasaki; Koichi Sakamoto, Tokyo, all of Japan

[73] Assignees: Kao Corporation; Mitsubishi Heavy Industries, Ltd., both of Tokyo, Japan

[21] Appl. No.: 863,017

[22] Filed: May 23, 1997

[30] Foreign Application Priority Data

May 23, 1996 [JP] Japan ..... 8-153184

[51] Int. Cl.[6] ..... C10L 1/32

[52] U.S. Cl. ..... 44/301; 44/302; 252/311.5

[58] Field of Search ..... 44/301, 302; 252/311.5

[56] References Cited

U.S. PATENT DOCUMENTS

| | | | |
|---|---|---|---|
| 4,842,616 | 6/1989 | Verhille | 44/51 |
| 5,024,676 | 6/1991 | Moriyama et al. . | |
| 5,411,558 | 5/1995 | Taniguchi et al. . | |
| 5,437,693 | 8/1995 | Iizuka et al. | 44/302 |
| 5,551,956 | 9/1996 | Moriyama et al. . | |
| 5,603,864 | 2/1997 | Silva et al. | 44/301 |

FOREIGN PATENT DOCUMENTS

| | | |
|---|---|---|
| 0301766A1 | 2/1989 | European Pat. Off. . |
| 0595640A1 | 5/1994 | European Pat. Off. . |
| 0732144A1 | 9/1996 | European Pat. Off. . |
| 1185394A | 7/1989 | Japan . |
| 1313595A | 12/1989 | Japan . |
| 96378519 | 12/1996 | WIPO . |
| 9638519 | 12/1996 | WIPO . |

*Primary Examiner*—Jerry D. Johnson

*Attorney, Agent, or Firm*—Birch, Stewart, Kolasch & Birch, LLP

[57] ABSTRACT

A method for producing a superheavy oil emulsion fuel comprising the steps of (i) preparing a liquid mixture comprising a superheavy oil, water, one or more nonionic surfactants having an HLB (hydrophilic-lipophilic balance) of 13 to 19, and optionally one or more stabilizers, and then agitating the resulting liquid mixture with a high shear rate of 1000/sec to 60000/sec, to give an oil-in-water (O/W) type emulsion fuel having a superheavy oil concentration of from 74 to 82% by weight; and (ii) adding at least one of ionic dispersants, and optionally water, to the emulsion fuel obtained in step (i), and then blending and agitating the resulting liquid mixture with a shear rate of 10/sec to 10000/sec, to give an oil-in-water (O/W) type emulsion fuel having a superheavy oil concentration of from 68 to 79% by weight. In step (i), the nonionic surfactants are contained in an amount of from 0.1 to 0.8% by weight of the emulsion fuel obtained in step (i), and the stabilizers are contained in an amount of from 0.001 to 0.5% by weight of the emulsion fuel obtained in step (i). In step (ii), the ionic dispersants are contained in an amount of from 0.01 to 0.5% by weight of the emulsion fuel obtained in step (ii).

12 Claims, No Drawings

METHOD FOR PRODUCING SUPERHEAVY OIL EMULSION FUEL AND FUEL PRODUCED THEREBY

BACKGROUND OF THE INVENTION

1. Field of the Invention

The present invention relates to a method for producing an oil-in-water type, superheavy oil emulsion fuel which is usable as fuels for thermoelectric power generation and an emulsion fuel produced by the above method.

2. Discussion of the Related Art

It has been well known that the superheavy oil emulsion fuels give stable emulsion fuels when used together with additives, such as emulsifiers and stabilizers, and various excellent emulsifiers to be used in emulsion fuel compositions have been developed (See Japanese Patent Laid-Open No. 1-185394, U.S. Pat. No. 5,024,676, and Japanese Patent Laid-Open No. 1-313595). However, insufficient long-term storage stability and the need for large amounts of emulsifiers are being problems in the conventional methods. There is a need for, the concentration of the superheavy oil to be made as high as possible. This is owing to the fact that the higher the concentration of the superheavy oil, or lower the concentration of water in the emulsion fuel, the smaller the heat loss during the combustion of the emulsion fuel resulting in a more valuable emulsion fuel. Therefore, an emulsion fuel having a high concentration of a superheavy oil and a small amount of coarse particles, with good flowability and easy handling is highly advantageous with respect to smaller heat loss and the ability to dilute the emulsion fuel.

Accordingly, an object of the present invention is to provide a method for producing an easy-to-handle superheavy oil emulsion fuel having a high superheavy oil concentration, good flowability, and good long-term storage stability.

Another object of the present invention is to provide a superheavy oil emulsion fuel obtainable by the above method.

These and other objects of the present invention will be apparent from the following description.

SUMMARY OF THE INVENTION

As a result of intensive research in view of solving the above problems, the present inventors have found that a stable emulsion can be obtained by agitating particular amounts of a superheavy oil, water, and nonionic surfactants, and optionally stabilizers, first under a high shear rate, and then agitating, after adding ionic dispersants, under medium shear rate, to give an emulsion fuel at a desired concentration of the superheavy fuel. The present invention has been completed based upon these findings. Incidentally, in the second step, only at least one of surfactants and stabilizers may be added without adding water.

Specifically, the present invention is concerned with the following:

(1) A method for producing a superheavy oil emulsion fuel comprising the steps of:

(i) preparing a liquid mixture comprising a superheavy oil, water, one or more nonionic surfactants having an HLB (hydrophilic-lipophilic balance) of 13 to 19, and optionally one or more stabilizers, and then agitating the resulting liquid mixture with a high shear rate of 1000/sec to 60000/sec, to give an oil-in-water (O/W) type emulsion fuel having a superheavy oil concentration of from 74 to 82% by weight, wherein the nonionic surfactants are contained in an amount of from 0.1 to 0.8% by weight of the emulsion fuel obtained in step (i), and wherein the stabilizers, when added, are added in an amount of from 0.001 to 0.5% by weight of the emulsion fuel obtained in step (i); and (ii) adding at least one ionic dispersant, and optionally water, to the emulsion fuel obtained in step (i), and then blending and agitating the resulting liquid mixture with a shear rate of 10/sec to 10000/sec, to give an oil-in-water (O/W) type emulsion fuel having a superheavy oil concentration of from 68 to 79% by weight, wherein the ionic dispersants added in step (ii) are added in an amount of from 0.01 to 0.5% by weight of the emulsion fuel obtained in step (ii);

(2) The method described in item (1), wherein at least one of anionic surfactants and cationic surfactants is further added in the preparation of the liquid mixture in step (i), the weight ratio of at least one of anionic surfactants and cationic surfactants to the nonionic surfactants being from 1/100 to 1/4;

(3) The method described in item (1) or item (2), wherein the stabilizers are at least one member selected from polymeric compounds and water-swellable clay minerals;

(4) The method described in any one of items (1) to (3), wherein the oil-in-water (O/W) type emulsion fuel in step (i) has a superheavy oil concentration of from 77 to 81% by weight;

(5) The method described in any one of items (1) to (4), wherein in the preparation of the liquid mixture in step (i), the nonionic surfactants are added in an amount of from 0.2 to 0.4% by weight of the emulsion fuel obtained in step (i), and the stabilizers, when added, are added in an amount of from 0.005 to 0.1% by weight of the emulsion fuel obtained in step (i); and wherein in step (ii), the dispersants are contained in an amount of from 0.02 to 0.2% by weight of the emulsion fuel obtained in step (ii);

(6) The method according to any one of items (1) to (5), wherein the weight ratio of the nonionic surfactants to the ionic dispersants, namely nonionic surfactants/ionic dispersants, is from 90/10 to 60/40 in the superheavy oil emulsion fuel obtained in step (ii);

(7) The method described in any one of items (1) to (6), wherein the liquid mixture in step (i) is agitated with a shear rate of from 5000/sec to 20000/sec, and wherein the liquid mixture in step (ii) is agitated with a shear rate of from 100/sec to 6000/sec;

(8) The method described in any one of items (1) to (7), wherein the oil-in-water (O/W) type emulsion fuel obtained in step (i) comprises oil droplets having a particle size distribution of which a 50%-cumulative particle size is from 3 to 30 $\mu$m, and coarse particles having particle sizes of 150 $\mu$m or more occupy 3% by weight or less in the entire oil droplets; (9) The method described in any one of items (1) to (8), wherein the oil-in-water (O/W) type emulsion fuel obtained in step (i) has a viscosity at 25° C. of from 400 to 3000 c.p.;

(10) The method described in any one of items (1) to (9), wherein a homomixer equipped with a high-shear turbine mixer is used in step (i) as an agitator with a high shear rate;

(11) The method described in any one of items (1) to (10), wherein the oil-in-water (O/W) type emulsion fuel obtained in step (i) comprises oil droplets of which coarse particles having particle sizes of 150 μm or more occupy 2% by weight or less in the entire oil droplets;

(12) The method described in any one of items (1) to (11), wherein in the preparation of the liquid mixture in step (i), at least one member selected from magnesium acetate, magnesium sulfate, magnesium nitrate, calcium acetate, calcium sulfate, calcium nitrate, iron acetate, iron sulfate, and iron nitrate is further added to the liquid mixture, in an amount of from 0.01 to 0.2% by weight of the emulsion fuel obtained in step (i); and

(13) A superheavy oil emulsion fuel obtainable by the method described in any one of items (1) to (12).

DETAILED DESCRIPTION OF THE INVENTION

The present invention will be explained in detail below.

The method for producing superheavy oil emulsion fuel of the present invention comprises two steps, namely step (i) and step (ii). The method of the present invention will be described in detail for each step (i) and step (ii).

1. Step (i)

Step (i) comprises preparing a liquid mixture comprising a superheavy oil, water, one or more nonionic surfactants having an HLB (hydrophilic-lipophilic balance) of 13 to 19, and optionally one or more stabilizers, and then agitating the resulting liquid mixture with a high shear rate of 1000/sec to 60000/sec, to give an oil-in-water (O/W) type emulsion fuel having a superheavy oil concentration of from 74 to 82% by weight, wherein the nonionic surfactants are contained in an amount of from 0.1 to 0.8% by weight of the emulsion fuel obtained in step (i), and wherein the stabilizers, when added, are added in an amount of from 0.001 to 0.5% by weight of the emulsion fuel obtained in step (i).

The "superheavy oil" usable in the present invention refers to those in a solid or semi-fluid state at room temperature, which do not flow unless heated to a high temperature. Examples of the superheavy oils include the following:

(1) Petroleum asphalts and mixtures thereof;

(2) Various treated products of petroleum asphalts, intermediates, residues, and mixtures thereof.

(3) High pour point-oils which do not even flow at high temperatures, or crude oils;

(4) Petroleum tar pitches and mixtures thereof; and (5) Bitumens (Orinoco tar and athabasca bitumen).

Examples of the nonionic surfactants usable in the present invention include the following ones:

(i) Alkylene oxide adducts of compounds having phenolic hydroxyl groups, such as phenol, m-cresol, butylphenol, octylphenol, nonylphenol, dodecylphenol, p-cumylphenol, and bisphenol A.

(ii) Alkylene oxide adducts of formalin (formaldehyde) condensates of compounds having phenolic hydroxyl groups, such as alkylphenols, phenol, m-cresol, styrenated phenol, and benzylated phenol, wherein the average degree of condensation is 1.2 to 100, preferably 2 to 20.

(iii) Alkylene oxide adducts of aliphatic alcohols and/or aliphatic amines each having 2 to 50 carbon atoms.

(iv) Block or random addition polymers of ethylene oxide/propylene oxide, ethylene oxide/butylene oxide, ethylene oxide/styrene oxide, ethylene oxide/propylene oxide/butylene oxide, ethylene oxide/propylene oxide/ethylene oxide, and ethylene oxide/propylene oxide/styrene oxide.

(v) Alkylene oxide adducts of polyhydric alcohols, such as glycerol, trimethylolpropane, pentaerythritol, sorbitol, sucrose, polyglycerols, ethylene glycol, polyethylene glycols, propylene glycol, and polypropylene glycols, or those of esters formed between the above-described polyhydric alcohols and fatty acids having 8 to 18 carbon atoms.

(vi) Alkylene oxide adducts of polyvalent amines having a plurality of active hydrogen atoms, such as ethylenediamine, tetraethylenediamine, and polyethyleneimine (weight-average molecular weight: 600 to 10,000).

(vii) Products formed by addition reaction of alkylene oxides with a mixture comprising one mol of fats and oils comprising triglyceride and 0.1 to 5 mol of one or more polyhydric alcohols and/or water, the polyhydric alcohol being at least one member selected from the group consisting of glycerol, trimethylolpropane, pentaerythritol, sorbitol, sucrose, ethylene glycol, polyethylene glycols having a weight-average molecular weight of 1000 or less, propylene glycol, and polypropylene glycols having a weight-average molecular weight of 1000 or less.

In each of the nonionic surfactants (i) to (vii), the alkylene oxide means, for example, ethylene oxide, propylene oxide, butylene oxide, styrene oxide, and combinations thereof.

In the present invention, the nonionic surfactants may be used alone or in combination of two or more kinds. Among the above nonionic surfactants, a preference is given those listed under item (i), specifically, alkylene oxide adducts of compounds having phenolic hydroxyl groups, such as octylphenol, nonylphenol, and dodecylphenol.

The nonionic surfactants usable in the present invention have an HLB of usually from 13 to 19, preferably from 13.5 to 15.5. The HLB of the nonionic surfactants is from 13 to 19 in order to obtain stable emulsion. The "HLB"values in the present invention refer to an abbreviation of a hydrophilic-lipophilic balance calculated from the Griffin's equation. Specifically, the HLB is an index for surface activity by expressing intensity ratios between a hydrophilic property and a lipophilic property of amphiphilics. Here, the found values of Griffin et al. are employed (W. C. Griffin, "Kirk-Othmer Encyclopedia of Chemical Technology," 3rd Ed., Vol. 8, p.913–916, John-Wiley (1979)).

The nonionic surfactant in the present invention used is added in an amount of from 0.1 to 0.8% by weight, preferably from 0.2 to 0.4% by weight, of the emulsion fuel obtained in step (i). The amount is preferably 0.8% by weight or less, from the aspect of maintaining good particle size of the oil particles in the resulting emulsion fuel without being too small, and the amount is preferably 0.1% by weight or more, from the aspect of maintaining good particle size of the oil particles without being too large as well as having good emulsion stability by the sufficient inclusion of the surfactants.

In the preparation of the liquid mixture in step (i), in addition to the nonionic surfactants, commercially available anionic surfactants and cationic surfactants may be optionally added to the liquid mixture, a weight ratio of the optional surfactants to the nonionic surfactant being preferably from 1/100 to 1/4, more preferably from 1/20 to 1/5.

Examples of the anionic surfactants usable in the present invention include the following ones.

(i) Sulfonates of aromatic ring compounds, such as naphthalenesulfonates, alkylnaphthalenesulfonates, alkylphenolsulfonates, and alkylbenzenesulfonates, or formalin (formaldehyde) condensates of sulfonates of aromatic ring compounds, wherein the average degree of condensation of formalin is from 1.2 to 100, more preferably from 2 to 20, and wherein the sulfonates are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts.

(ii) Lignin sulfonic acid, salts thereof, or derivatives thereof, formalin (formaldehyde) condensates of lignin sulfonic acid and sulfonic acids of aromatic compounds, such as naphthalenesulfonic acid and alkylnaphthalenesulfonic acids, and salts thereof, wherein the salts for both the lignin sulfonates and the sulfonates of aromatic compounds are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts, and wherein the average degree of condensation of formalin is from 1.2 to 50, preferably from 2 to 20. Among the lignins, excellent performance at high temperatures can be particularly achieved when a modified lignin, for instance, those substituted by one or more carboxyl groups, is used.

(iii) Polystyrenesulfonic acids or salts thereof, copolymers of styrenesulfonic acid with other copolymerizable monomer(s), or salts thereof, wherein the weight-average molecular weight is from 500 to 500,000, preferably from 2,000 to 100,000, and wherein the salts are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts. Here, typical examples of the copolymerizable monomers include acrylic acid, methacrylic acid, vinyl acetate, acrylic ester, olefins, allyl alcohols and ethylene oxide adducts thereof, and acrylamide methylpropylsulfonic acid.

(iv) Polymers of dicyclopentadienesulfonic acid or salts thereof, wherein the weight-average molecular weight of the polymers is from 500 to 500,000, preferably from 2,000 to 100,000, and wherein the salts are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts.

(v) Copolymers of maleic anhydride and/or itaconic anhydride with other copolymerizable monomer(s), or salts thereof, wherein the weight-average molecular weight is from 500 to 500,000, preferably from 1,500 to 100,000, and wherein the salts are exemplified by ammonium salts; and alkali metal salts, such as sodium salts and potassium salts. Here, typical examples of the copolymerizable monomers include olefins, such as ethylene, propylene, butylene, pentene, hexene, heptene, octene, nonene, decene, undecene, dodecene, tridecene, tetradecene, pentadecene, and hexadecene, styrene, vinyl acetate, acrylic ester, acrylic acid, and methacrylic acid.

(vi) Maleinized liquid polybutadienes or salts thereof, wherein the weight-average molecular weight of the liquid polybutadienes as the starting materials is from 500 to 200,000, preferably from 1,000 to 50,000, and wherein the degree of maleinization is at a level necessary for dissolving the maleinized liquid polybutadiene in water, preferably from 40 to 70%, and wherein the salts are exemplified by ammonium salts, and alkali metal salts, such as sodium salts and potassium salts.

(vii) Anionic surfactants having in the molecule one or two hydrophilic groups, selected from the following (a) to (h):

(a) Sulfuric ester salts of alcohols having 4 to 18 carbon atoms, wherein the salts are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts. Typical examples thereof include sodium dodecyl sulfate and sodium octyl sulfate.

(b) Alkanesulfonic acids, alkenesulfonic acids, and/or alkylarylsulfonic acids, each having 4 to 18 carbon atoms, or salts thereof, wherein the salts are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts. Typical examples thereof include sodium dodecylbenzene sulfonate, sodium butylnaphthalene sulfonate, and sodium dodecane sulfonate.

(c) Sulfates or phosphates of alkylene oxide adducts of compounds having in the molecule one or more active hydrogen atoms, or salts thereof, wherein the salts are exemplified by ammonium salts, or alkali metal salts or alkaline earth metal salts, such as sodium salts, potassium salts, magnesium salts, and calcium salts. Typical examples thereof include sulfuric ester sodium salts of polyoxyethylene(3 mol) nonyl phenyl ether, and phosphoric ester sodium salts of polyoxyethylene(3 mol) dodecyl ether.

(d) Sulfosuccinic ester salts of saturated or unsaturated fatty acids having 4 to 22 carbon atoms, wherein the salts are exemplified by ammonium salts, and alkali metal salts, such as sodium salts and potassium salts. Typical examples thereof include sodium dioctylsulfosuccinate, ammonium dioctylsulfosuccinate, and sodium dibutylsulfosuccinate.

(e) Alkyldiphenylether disulfonic acids or salts thereof, of which the alkyl group has 8 to 18 carbon atoms, and wherein the salts are exemplified by ammonium salts, or alkali metal salts or alkaline earth metal salts, such as sodium salts, potassium salts, magnesium salts, and calcium salts.

(f) Rosins or salts thereof, wherein the salts are exemplified by ammonium salts, and alkali metal salts, such as sodium salts and potassium salts. Examples thereof include mixed tall acids comprising a tall rosin and a higher fatty acid, and salts thereof.

(g) Alkanefatty acids or alkenefatty acids each having 4 to 18 carbon atoms, or salts thereof, wherein the salts are exemplified by ammonium salts, and alkali metal salts, such as sodium salts and potassium salts.

(h) α-Sulfofatty ester salts of which the alkyl group has 4 to 22 carbon atoms and derivatives thereof, wherein the salts are exemplified by ammonium salts, or alkali metal salts or alkaline earth metal salts, such as sodium salts, potassium salts, and magnesium salts.

Among the anionic surfactants listed above, a preference is given to the lignin sulfonates, the formalin condensates of lignin sulfonic acid and the formalin condensates of naphthalenesulfonic acid or salts thereof, and the formalin condensates of naphthalenesulfonates because they show overall superior performance in charging the particles.

The cationic surfactants usable in the present invention are the following ones.

(i) Alkylamine salts and/or alkenylamine salts obtainable by neutralizing an alkylamine or alkenylamine, each of alkyl or alkenyl group having 4 to 18 carbon atoms, with an inorganic acid and/or an organic acid, such as hydrochloric acid and acetic acid.

(ii) Quaternary ammonium salts represented by the following general formulae (A), (B), and (C):

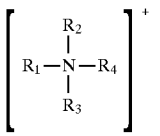

(A)

wherein $R_1$, $R_2$, $R_3$, and $R_4$, which may be identical or different, independently stand for an alkyl group or alkenyl group, each having 1 to 18 carbon atoms; and $X^-$ stands for a counter anion, including chlorine ion or bromine ion;

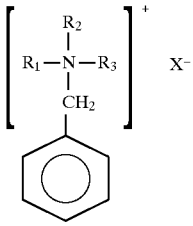

(B)

wherein $R_1$, $R_2$, $R_3$, and $X^-$ are as defined above; and

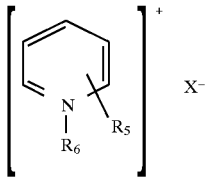

(C)

wherein $R_5$ stands for an alkyl group or alkenyl group having 8 to 18 carbon atoms; $R_6$ stands for a hydrogen atom or a methyl group; and $X^-$ is as defined above.

(iii) Alkylbetaines or alkenylbetaines represented by the following general formula:

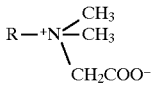

wherein R stands for an alkyl group or alkenyl group, each having 8 to 18 carbon atoms.

(iv) Alkylamine oxides or alkenylamine oxides represented by the following general formula:

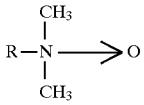

wherein R is as defined in item (iii).

(v) Alkylalanines or alkenylalanines represented by the following general formula:

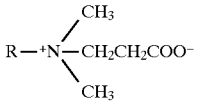

wherein R is as defined in item (iii).

(vi) Alkylene oxide adduct polymers of diamine or triamine represented by the following general formula (D) or (E):

$$RNHC_3H_6NHY \quad (D)$$

$$RNHC_3H_6N\begin{matrix} Y \\ Y' \end{matrix} \quad (E)$$

wherein R is as defined in item (iii); and Y and Y', which may be identical or different, each stands for an oxyethylene moiety represented by the general formula:

$$\left(C_2H_4O\right)_m H$$

wherein m stands for a number of from 1 to 50.

(vii)Polyamine salts represented by the following formula (F) or (G):

$$RNHC_3H_6NHX' \quad (F)$$

$$RNH\ (C_3H_6NH)_2X' \quad (G)$$

wherein R is as defined in item (iii); and X' stands for an inorganic acid or organic acid, such as hydrochloric acid and acetic acid.

Examples of stabilizers which may be used in combination with the nonionic surfactants in step (i) include (1) polymeric compounds, including naturally occurring polymers and synthetic polymers, and (2) water-swellable clay minerals. In other words, the stabilizers usable in the present invention may be selected from items (1) and (2) listed below.

(1) Polymeric Compounds

Hydrophilic Naturally Occurring Polymers Derived from Naturally Occurring Substances Hydrophilic Polymers Derived from Microorganism (Polysaccharides)

1) Xanthan gum
2) Pullulan
3) Dextran

Hydrophilic Polymers Derived from Plants (Polysaccharides)

1) Derived from marine algae: agar, carrageenan, furcellaran, alginic acid and salts (Na, K, $NH_4$, Ca, or Mg) thereof
2) Derived from seeds: locust bean gum, guar gum, tara gum 3) Trees (exudates): gum arabic, gum karaya, gum tragacanth; and
4) Derived from fruits: pectin Hydrophilic Polymers Derived from Animals (Proteins)
1) Gelatin
2) Casein Naturally Occurring Polymer Derivatives
1) Cellulose derivatives, such as carboxymethylcellulose
2) Chemically modified starch Water-Soluble Synthetic Polymers (a) Homopolymers or copolymers of acrylic acid or derivatives thereof represented by the following general formula:

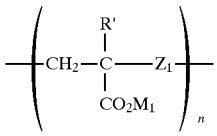

wherein R' stands for a hydrogen atom, a methyl group, or an ethyl group; $M_1$ stands for a hydrogen atom, a sodium ion, a potassium ion, a lithium ion, or an ammonium ion; $Z_1$ stands for a divalent group which is derived from a monomer and salts thereof copolymerizable therewith, the divalent group being represented by the following general formula:

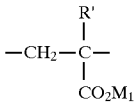

wherein R' and $M_1$ are as defined above, wherein the salts of the copolymerizable monomers are exemplified by ammonium salts, sodium salts, potassium salts, and lithium salts; and n stands for a number of from 50 to 100,000. Examples of the copolymerizable monomers include maleic acid (anhydride), itaconic acid (anhydride), α-olefins, acrylamide, vinylsulfonic acid, allylsulfonic acid, methallylsulfonic acid, and acrylamidomethylpropylsulfonic acid, and salts thereof, including ammonium salts, sodium salts, potassium salts, and lithium salts; dialkyl aminoethyl methacrylates, such as dimethyl aminoethyl methacrylate and diethyl aminoethyl methacrylate and salts thereof, including halogenides, such as chloride, diethyl sulfate, and dimethyl sulfate.

(b) Homopolymers or copolymers of acrylamide or derivatives thereof represented by the following general formula:

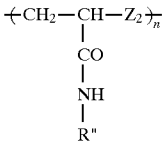

wherein R" stands for a hydrogen atom or a $C_2H_4OH$ group; $Z_2$ stands for a divalent group which is derived from a monomer or salts thereof, the divalent group being represented by the following general formula:

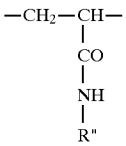

wherein R" is as defined above, and wherein the salts of the copolymerizable monomers are exemplified by ammonium salts, sodium salts, potassium salts, and lithium salts; and n stands for a number of from 50 to 100,000. Examples of the copolymerizable monomers include vinylsulfonic acid, allylsulfonic acid, methallylsulfonic acid, acrylamidomethylpropylsulfonic acid, and salts thereof, including ammonium salts, sodium salts, potassium salts, and lithium salts; dialkyl aminoethyl methacrylates, such as dimethyl aminoethyl methacrylate and dimethyl aminoethyl methacrylate and salts thereof, quaternary compounds thereof, including halogenides, such as chloride, diethyl sulfate, and dimethyl sulfate; styrene; α-olefins having 2 to 18 carbon atoms; and vinylallyl alcohols.

(c) Homopolymers of maleic anhydride or itaconic anhydride, or copolymers thereof represented by the following general formula:

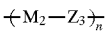

wherein $M_2$ stands for a maleic anhydride unit or itaconic anhydride unit; $Z_3$ stands for an α-olefin unit, the α-olefins including ethylene, propylene, butylene, isobutylene, octene, decene, and dodecene, or a styrene unit; and n stands for a number of from 50 to 100,000.

(d) Polyvinyl alcohols or copolymers thereof represented by the following general formula:

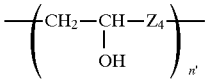

wherein $Z_4$ stands for a vinyl acetate unit or styrene unit; and n' stands for a number of from 30 to 100,000.

(e) Homopolymers of vinylpyrrolidone, or copolymers thereof represented by the following general formula:

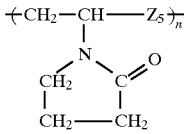

wherein $Z_5$ stands for a divalent group which is derived from a monomer copolymerizable with a vinylpyrrolidone monomer, wherein the salts of the monomers copolymerizable with vinylpyrrolidone monomers include ammonium salts, sodium salts, potassium salts, and lithium salts. Examples of the monomers copolymerizable with the vinylpyrrolidone monomer or salts thereof include acrylamide, vinylsulfonic acid, methallylsulfonic acid, maleic anhydride, itaconic anhydride, and salts thereof, such as ammonium salts, sodium salts, potassium salts, and lithium salts; styrene; α-olefins having 2 to 18 carbon atoms; and n stands for a number of from 50 to 100,000.

(f) Polyalkylene oxides having a weight-average molecular weight of from 10,000 to 5,000,000, wherein the ethylene oxide content is 95% by weight or more, which may include those containing in the molecule 5% by weight or less of various block polymers of propylene oxide, butylene oxide, and styrene oxide or alkylallyl groups or alkyl groups.

Among these polymeric compounds, naturally occurring polymeric derivatives, including cellulose derivatives, such as carboxymethylcellulose, and hydrophilic polymers derived from microorganism, such as xanthan gum, are suitably used in the present invention.

(2) Water-Swellable Clay Minerals

The water-swellable clay minerals usable in the present invention include the following ones.

The clay minerals usable in the present invention is a highly swellable fine clay mineral, wherein the term "highly swellable" clay minerals refer to those bound with a large amount of water molecules when the clay minerals are suspended in water, so as to have a relaxation time ($T_2$) for water molecules of preferably from 900 msec or less, more preferably 500 msec or less, the relaxation time for water molecules being measured by a nuclear magnetic resonance spectrometer when the clay minerals are suspended in water in an amount of 1% by weight on a dry basis. When the relaxation time for the water molecules is 900 msec or less, a good binding force of the clay minerals to the water molecules can be maintained, thereby making it possible to sufficiently attain the effects of the present invention. In addition, the term "fine clay mineral" refers to the clay minerals having an average particle size of preferably from 100 $\mu$m or less. The clay mineral has an average particle size of preferably 100 $\mu$m or less, a good binding force of the clay minerals to the water molecules can be maintained, and at the same time sedimentation of the clay minerals is liable to be inhibited, thereby making it possible to sufficiently attain the effects of the present invention.

Specifically, the fine clay minerals having a high swellability and a high binding force to the water molecules, including smectites, vermiculites, and chlorites, fall within the scope of the present invention. Among them, however, those having a $T_2$ value exceeding 900 msec are outside the scope of the present invention. Further, since kaolin produced in Georgia, U.S.A., general kaolin and talc have weak binding forces to the water molecules, they are excluded from the scope of the present invention.

The highly swellable fine clay minerals, such as smectites, vermiculites, and chlorites, usable in the present invention will be explained in detail below.

(A) Smectite has a complicated chemical composition comprising two tetrahedral sheets and one octahedral sheet inserted therebetween (namely a 2:1 layer), because substitution takes place in a wide range and various ions accompanied by water molecules are intercalated. The smectite is represented by, for example, the following general formula:

$$X_m(Y^{2+}, Y^{3+})_{2-3}Z_4O_{10}(OH)_2.nH_2O,$$

wherein X stands for K, Na, ½ Ca, or ½ Mg; $y^{2+}$ stands for $Mg^{2+}$, $Fe^{2+}$, $Mn^{2+}$, $Ni^{2+}$, $Zn^{2+}$, or Li, $Y^{3+}$ stands for $Al^{3+}$, $Fe^{3+}$, $Mn^{3+}$, or $Cr^{3+}$; and Z stands for Si and/or Al, with proviso that X, Y, and Z stand for an intercalated cation, an octahedral cation, and a tetrahedral cation, respectively.

Typical examples of the smectites are the following ones:

Dioctahedral (octahedral cations being mainly trivalent):

Montmorillonites represented by, for example, the following formula:

$$X_{0.33}(Al_{1.67}Mg_{0.33})Si_4O_{10}(OH)_2.nH_2O;$$

Beidellites represented by, for example, the following formula:

$$X_{0.33}(Al_2)(Al_{0.33}Si_{3.67})O_{10}(OH)_2.nH_2O;$$

and

Nontronites represented by, for example, the following formula:

$$X_{0.33}(Fe(III)_2)(Al_{0.33}Si_{3.67})O_{10},(OH)_2.nH_2O.$$

Trioctahedral (octahedral cations being mainly divalent):

Saponites represented by, for example, the following formula:

$$X_{0.33}(Mg_3)(Al_{0.33}Si_{3.67})O_{10}(OH)_2.nH_2O;$$

Iron saponites represented by, for example, the following formula:

$$X_{0.33}(Mg,Fe(II))_3(Al_{0.33}Si_{3.67})O_{10}(OH)_2.nH_2O;$$

Hectorites represented by, for example, the following formula:

$$X_{0.33}(Mg_{2.67}Li_{0.33})Si_4O_{10}(OH)_2.nH_2O;$$

Sauconites represented by, for example, the following formula:

$$X_{0.33}(Mg,Zn)_3(Si_{3.67}Al_{0.33})O_{10}(OH)_2.nH_2O;$$

and

Stevensites represented by, for example, the following formula:

$$X_{0.33/2}(Mg_{2.97})Si_4O_{10}(OH)_2.nH_2O.$$

Among the smectites listed above, the montmorillonites, the beidellites, and the nontronites constitute a series which can be subjected to isomorphous substitution. The stevensites have layer charges of one-half of that of the other smectites, and thus having an intermediary property of the dioctahedral smectites and the trioctahedral smectites.

(B) Vermiculites pertain to 2:1 layer silicates and are represented by, for example, the following formula:

$$(Mg,Fe(III),Al)_{2-3}(Si_{4-x}Al_x)O_{10}(OH)_2(M^+,M^{2+}{}_{1/2})_x.nH_2O.$$

In the above formula, M stands for an intercalated exchangeable cation, and when the vermiculite is in the form of coarse particles, M is mainly composed of Mg. "n" in the above formula stands for the amount of water, and when the intercalated cation is Mg, water forms a bimolecular layer over a wide temperature range and n is in the range of from about 3.5 to 5. "x" in the above formula stands for layer charges which are in the range of from 0.6 to 0.9.

In the above formula, it is assumed that all of the layer charges are generated by the substitution of tetrahedral cations. However, in certain cases, the octahedral sheet may actually carry a negative charge to which the layer charges are ascribed. The number of octahedral cations is 2 to 3, and the vermiculites are classified into dioctahedral vermiculites and trioctahedral vermiculites. The vermiculites in the form of coarse particles obtainable by the weathering of biotite and phlogopite are trioctahedral vermiculites.

(C) The structures of the chlorites are similar to those of the smectites and the vermiculites, and the base plane interval is 14 to 15 Å. The chlorites are typically a 2:1 hydrated silicate which can be classified into trioctahedral chlorites and dioctahedral chlorites depending on the properties of the 2:1 layer.

The trioctahedral chlorites are represented by, for example, the following formula:

$$(R_{6-x}^{2+}R_x^{3+})(Si_{4-x}Al_x)O_{10}(OH)_8.$$

In the above formula, $R^{2+}$ is mainly composed of $Mg^{2+}$ and $Fe^{2+}$, which may also include $Mn^{2+}$ and $Ni^{2+}$; and $R^{3+}$, is mainly composed of Al, which may also include $Fe^{3+}$ and $Cr^{3+}$. "x" in the above formula is a value of from 0.8 to 1.6.

A chlorite wherein $R^{2+}$ is mainly composed of $Mg^{2+}$ is so-called "clinochlore" [e.g. $(Mg_5Al)(SI_3Al)O_{10}(OH)_8$]; and a chlorite wherein $R^{2+}$ is mainly composed of Fe(II) is so-called "chamosite" [e.g. $(Fe_5Al)(Si_3Al)O_{10}(OH)_8$]. Examples of other trioctahedral chlorites include "pennantite" wherein $R^{2+}$ is mainly composed of Mn(II); and "nimite" wherein $R^{2+}$ is mainly composed of Ni(II).

The dioctahedral chlorites wherein the octahedral cation is mainly composed of Al are classified into the following three kinds.

Sudoite [e.g. $(Mg,Al)_{4.6-5}(Si,Al)_4O_{10}(OH)_8$;

Cookeite [e.g. $(LiAl_4)(Si_3Al)O_{10}(OH)_8$; and

Donbassite [e.g. $Al_{4-4.2}R_{0.2}(Si,Al)_4O_{10}(OH)_8$.

The clay minerals comprising montmorillonite, the clay mineral pertaining to smectite, as the main component, and further containing as impurities, quartz, α-cristobalite, opal, feldspar, mica, zeolite, calcite, dolomite, gypsum, and iron oxide are so-called "bentonite." The bentonites include sodium bentonite rich in Na ions and calcium bentonite rich in Ca ions. Since sodium bentonite has high swellability, it falls within the scope of the clay minerals of the present invention, while calcium bentonite has notably low swellability that it is excluded from the scope of the present invention.

These stabilizers are contained in an amount of from 0.001 to 0.5% by weight, preferably from 0.001 to 0.1% by weight, most preferably from 0.005 to 0.1% by weight, of the emulsion fuel obtained in step (i). The addition of the stabilizers allows to suppress the mobility in the interface of the oil droplets, so that the resulting emulsion fuels may be stabilized.

In addition, aside from the stabilizers mentioned above, at least one member selected from magnesium acetate, magnesium sulfate, magnesium nitrate, calcium acetate, calcium sulfate, calcium nitrate, iron acetate, iron sulfate, and iron nitrate is further added to the liquid mixture, may be added, to thereby give a good emulsion stability effect. In this case, these stabilizers are contained in an amount of from 0.01 to 0.2% by weight, preferably from 0.05 to 0.1% by weight, of the emulsion fuel obtained in step (i).

In step (i), the agitators to be used when preparing a liquid mixture comprising a superheavy oil, water, a nonionic surfactant, and optional stabilizers are not particularly required to have high shear rates, and any one of general agitators, such as propeller agitators, will suffice. The agitation after the preparation of the liquid mixture needs to be carried out by agitators with high shear rates. Examples thereof include line mixers, arrow blade turbine blade mixers, full margin-type blade mixers, high-shear turbine mixers, and homogenizers. From the viewpoint of industrial efficiency, homomixers equipped with high-shear turbine mixers are preferably used. Here, the term "high shear rate" refers to a shear rate of from 1,000/sec to 60,000/sec, preferably from 5,000/sec to 20,000/sec. By agitating with such a high shear rate, the oil-in-water (O/W) type emulsion fuel having a concentration of the superheavy oil of from 74 to 82% by weight, preferably from 77 to 81% by weight. By agitating the liquid mixture with such a high shear rate, the oil-in water (O/W) emulsion fuel having a superheavy oil concentration of from 74 to 82% by weight, preferably from 77 to 81% by weight can be produced. The water is added in step (i) so as to make up 100% by weight with the entire emulsion fuel, namely, the amount of water is from 17 to 25% by weight.

The kinds and the amounts of the nonionic surfactants, the shear rates, and time required for agitation of the liquid mixture, and viscosity during agitation have to suitably adjusted so that the oil-in-water (O/W) emulsion fuel obtained in step (i) has a particle size distribution wherein a 50%-cumulative particle size is preferably from 3 to 30 μm, more preferably 8 to 20 μm, and wherein coarse particles having particle sizes of 150 μm or more occupy preferably 3% by weight or less, more preferably 2% by weight or less, still more preferably 1% by weight or less, in the entire emulsion fuel. The viscosity of the resulting oil-in-water emulsion fuel is preferably 400 c.p. or more (at 250° C.), more preferably from 400 to 3000 c.p. (at 25° C.). Incidentally, the term "particle size" used herein refers to particle diameter. The "particle size" and "amount of coarse particles" are evaluated by methods described in Examples which are set forth hereinbelow.

2. Step (ii)

Step (ii) comprises adding at least one of water and ionic dispersants to the emulsion fuel obtained in step (i), and then blending and agitating the resulting liquid mixture with a shear rate of 10/sec to 10000/sec, to give an oil-in-water (O/W) type emulsion fuel having a superheavy oil concentration of from 68 to 79% by weight, wherein the ionic dispersants, when added, are contained in an amount of from 0.01 to 0.5% by weight of the emulsion fuel obtained in step (ii).

The ionic dispersants usable in step (ii) include the following anionic surfactants.

(i) Sulfonates of aromatic ring compounds, such as naphthalenesulfonates, alkylnaphthalenesulfonates, alkylphenolsulfonates, and alkylbenzenesulfonates, or formalin (formaldehyde) condensates of sulfonates of aromatic ring compounds, wherein the average degree of condensation of formalin is from 1.2 to 100, more preferably from 2 to 20, and wherein the sulfonates are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts.

(ii) Lignin sulfonic acid, salts thereof, or derivatives thereof, formalin (formaldehyde) condensates of lignin sulfonic acid and sulfonic acids of aromatic compounds, such as naphthalenesulfonic acid and alkylnaphthalenesulfonic acids, and salts thereof, wherein the salts for both the lignin sulfonates and the sulfonates of aromatic compounds are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts, and wherein the average degree of condensation of formalin is from 1.2 to 50, preferably from 2 to 20. Among the lignins, excellent performance at high temperatures can be particularly achieved when a modified lignin, for instance, those substituted by one or more carboxyl groups, is used.

(iii) Polystyrenesulfonic acids or salts thereof, copolymers of styrenesulfonic acid with other copolymerizable monomer(s), or salts thereof, wherein the weight-average molecular weight is from 500 to 500,000, preferably from 2,000 to 100,000, and wherein the salts are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts. Here, typical examples of the copolymerizable monomers include acrylic acid, methacrylic acid, vinyl acetate, acrylic ester, olefins, allyl alcohols and ethylene oxide adducts thereof, and acrylamide methylpropylsulfonic acid.

(iv) Polymers of dicyclopentadienesulfonic acid or salts thereof, wherein the weight-average molecular weight of the polymers is from 500 to 500,000, preferably from 2,000 to 100,000, and wherein the salts are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts.

(v) Copolymers of maleic anhydride and/or itaconic anhydride with other copolymerizable monomer(s), or salts thereof, wherein the weight-average molecular weight is from 500 to 500,000, preferably from 1,500 to 100,000, and wherein the salts are exemplified by ammonium salts; and alkali metal salts, such as sodium salts and potassium salts. Here, typical examples of the copolymerizable monomers include olefins, such as ethylene, propylene, butylene, pentene, hexene, heptene, octene, nonene, decene, undecene, dodecene, tridecene, tetradecene, pentadecene, and hexadecene, styrene, vinyl acetate, acrylic ester, acrylic acid, and methacrylic acid.

(vi) Maleinized liquid polybutadienes or salts thereof, wherein the weight-average molecular weight of the liquid polybutadienes as the starting materials is from 500 to 200,000, preferably from 1,000 to 50,000, and wherein the degree of maleinization is at a level necessary for dissolving the maleinized liquid polybutadiene in water, preferably from 40 to 70%, and wherein the salts are exemplified by ammonium salts, and alkali metal salts, such as sodium salts and potassium salts.

(vii) Anionic surfactants having in the molecule one or two hydrophilic groups, selected from the following (a) to (h):

(a) Sulfuric ester salts of alcohols having 4 to 18 carbon atoms, wherein the salts are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts. Typical examples thereof include sodium dodecyl sulfate and sodium octyl sulfate.

(b) Alkanesulfonic acids, alkenesulfonic acids, and/or alkylarylsulfonic acids, each having 4 to 18 carbon atoms, or salts thereof, wherein the salts are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts. Typical examples thereof include sodium dodecylbenzene sulfonate, sodium butylnaphthalene sulfonate, and sodium dodecane sulfonate.

(c) Sulfates or phosphates of alkylene oxide adducts of compounds having in the molecule one or more active hydrogen atoms, or salts thereof, wherein the salts are exemplified by ammonium salts, or alkali metal salts or alkaline earth metal salts, such as sodium salts, potassium salts, magnesium salts, and calcium salts. Typical examples thereof include sulfuric ester sodium salts of polyoxyethylene(3 mol) nonyl phenyl ether, and phosphoric ester sodium salts of polyoxyethylene(3 mol) dodecyl ether.

(d) Sulfosuccinic ester salts of saturated or unsaturated fatty acids having 4 to 22 carbon atoms, wherein the salts are exemplified by ammonium salts, and alkali metal salts, such as sodium salts and potassium salts. Typical examples thereof include sodium dioctylsulfosuccinate, ammonium dioctylsulfosuccinate, and sodium dibutylsulfosuccinate.

(e) Alkyldiphenylether disulfonic acids or salts thereof, of which the alkyl group has 8 to 18 carbon atoms, and wherein the salts are exemplified by ammonium salts, or alkali metal salts or alkaline earth metal salts, such as sodium salts, potassium salts, magnesium salts, and calcium salts.

(f) Rosins or salts thereof, wherein the salts are exemplified by ammonium salts, and alkali metal salts, such as sodium salts and potassium salts. Examples thereof include mixed tall acids comprising a tall rosin and a higher fatty acid, and salts thereof.

(g) Alkanefatty acids or alkenefatty acids each having 4 to 18 carbon atoms, or salts thereof, wherein the salts are exemplified by ammonium salts, and alkali metal salts, such as sodium salts and potassium salts.

(h) α-Sulfofatty ester salts of which the alkyl group has 4 to 22 carbon atoms and derivatives thereof, wherein the salts are exemplified by ammonium salts, or alkali metal salts or alkaline earth metal salts, such as sodium salts, potassium salts, and magnesium salts.

Among the anionic surfactants listed above, a preference is given to the lignin sulfonates, the formalin condensates of lignin sulfonic acid and the formalin condensates of naphthalenesulfonic acid or salts thereof, and the formalin condensates of naphthalenesulfonates because they show overall superior performance in charging the particles.

The weight ratio of the ionic dispersants to the nonionic surfactants used in step (i) is preferably from 10/90 to 40/60 in the superheavy oil emulsion fuel obtained in step (ii).

The amount of the ionic dispersants in the present invention are so adjusted that the amount thereof makes up from 0.01 to 0.5% by weight, preferably 0.02 to 0.2% by weight of the emulsion fuel obtained in step (ii). The ionic dispersant may be added as it is, or as an aqueous solution.

In addition, cationic surfactants, nonionic surfactants, thickening agents, and the stabilizers, namely polymeric compounds or water-swellable clay minerals usable in step (i), may be added as long as added in an amount expressed by weight ratio to the anionic dispersants, is preferably within the range of from 1/100 to 1/5.

In step (ii), the agitation while adding to and blending at least one of water and ionic dispersants with the emulsion fuel obtained in step (i) is carried out with a generally employed agitator, such as propeller agitators. In step (ii), subsequent to the preparation of the liquid mixture, the resulting liquid mixture is agitated with a sheer rate of from 10/sec to 10000/sec, preferably from 100/sec to 6000/sec. The shear rate is preferably 10000/sec or less from the viewpoint of significantly reducing the effects to the oil droplet particles of the emulsion fuel obtained in step (ii), thereby making it possible to maintain good long-term storage stability of the resulting emulsion fuel.

The resulting emulsion fuel obtained in step (ii) comprising the oil-in-water (O/W) droplets has a superheavy oil concentration of from 68 to 79% by weight, preferably from 75 to 79% by weight, and a viscosity at 25° C. is preferably from 200 to 1500 c.p., more preferably from 300 to 600 c.p. When optionally using water, the concentration of the superheavy oil in the emulsion fuel obtainable in step (ii) is lowered from that in the emulsion fuel obtainable in step (i) preferably by 1 to 6% by weight. Also, the emulsion fuel obtained in step (ii) comprises the oil-in-water (O/W) droplets having a particle size distribution of which a 50%-cumulative particle size is preferably from 8 to 30 μm, more preferably from 10 to 20 μm, still more preferably from 12 to 16 μm, and coarse particles having particle sizes of 150 μm or more occupy preferably 3% by weight or less, more preferably 2% by weight or less, still more preferably 1% by weight or less, in the entire oil droplets, which is usable as fuels for thermoelectric power generation.

The superheavy oil emulsion fuel obtainable by the method of the present invention having a high superheavy oil concentration has a small amount of coarse particles and good flowability, and also has good long-term storage stability, so that its handling is made easy, thereby making it highly valuable when used as fuels.

EXAMPLES

The present invention will be explained in detail by means of the following working examples, without intending to restrict the scope of the present invention thereto.

Example 1

A 800 ml-stainless steel container was charged with given amounts of water and asphalt ("STRAIGHT ASPHALT," according to JIS K-2207, manufactured by Cosmo Oil Co.; penetration: 80 to 100), and at least one of surfactants and stabilizers shown in Tables 1 to 6, and the ingredients were heated to a given temperature of 80° C. in a thermostat. Thereafter, the mixture in the container was mixed in advance using an agitator equipped with double, helical ribbon blades for 5 minutes at a rotational speed of 60 r.p.m., and then the resulting mixture was blended and emulsified using a "T.K. HOMO MIXER, Model M" (equipped with low-viscosity agitating blades; manufactured by Tokushu Kika Kogyo) to produce an emulsion fuel under the following conditions. Here, the emulsion fuel prepared above is referred to as "concentrated (conc.) emulsion," and this step is referred to as "Step (i)."

The agitation conditions are as follows.

Agitation rotational speed: 8000 r.p.m.

Agitation time: 2 minutes.

Temperature: 80° C.

Shear rate: 12000/sec.

Here, the specific gravity of water is 0.997 (25° C.), and the specific gravity of oil is 1.026 (25° C.). The viscosity is measured by using a double, cylindrical rotational viscometer "RV-2" (equipped with a sensor "MV-1," manufactured by Haake Co.) at 25° C. while applying a shearing rate of 100/sec.

The particle size of the oil droplets of the obtained emulsion fuel is evaluated by using a granulometer "HR850-B" (manufactured by Cyrus Co.) to determine 50%-cumulative particle size (average particle diameter).

Specifically, the particle size is evaluated by the following method. Several droplets of the emulsion fuel are added in an aqueous solution containing 0.3% by weight of a non-ionic surfactant (polyoxyethylene(20 mol) nonyl phenyl ether), and the resulting mixture is agitated using a stirrer, to provide a homogeneous liquid mixture. The homogeneous liquid mixture obtained above is placed in a granulometer to evaluate granularity. The measurement mode is set at 1 to 600 μm.

The amount of coarse particles is evaluated by measuring the components having particle sizes of 150 μm or more using a wet sieve. Specifically, 20 g of each the emulsion fuels is weighed and then poured on the sieve. After rinsing the mesh-on particles with water, they are dried with a vacuum dryer. The amount of the particles remaining on the sieve after drying is measured to calculate the amount of coarse particles.

Next, given amounts of water heated at 80° C. and an ionic dispersant listed in Table 1 to 6 were added to the concentrated emulsion prepared above. The mixture in the container was mixed in advance using an agitator equipped with double, helical ribbon blades for 5 minutes at a rotational speed of 60 r.p.m. Thereafter, the resulting mixture was blended and emulsified using a "T. K. HOMO MIXER, Model M" (manufactured by Tokushu Kika Kogyo) to produce a desired emulsion fuel under the following conditions. Here, this step is referred to as "Step (ii)."

The agitation conditions are as follows:

Agitation rotational speed: 3000 r.p.m.

Agitation time: 2 minutes.

Temperature: 80° C.

Shear rate: 4500/sec.

Inventive Sample Nos. 1 to 29 thus prepared are shown in Table 1 to 6. Here, except for Inventive Sample No. 29 where it was prepared by a method which was different from method of preparing the remaining Inventive Samples in that Step (ii) was carried out at 25° C., and Inventive Samples were all prepared under the same conditions. The average particle diameter immediately after the preparation and the amount of coarse particles were measured in the same manner as above.

Also, the obtained emulsion fuel is stored for a long term (three months), and emulsion stability after three month is evaluated by the amount of sediments, and the emulsion stability is determined by the following standards:

⊚: Very excellent;

○: Good;

Δ: Slight effect; and x: No effects.

In the tables, carboxymethylcellulose is abbreviated as "CMC."

TABLE 1

| Inventive Sample Nos. | Surfactants and Stabilizers | Step (i) Thick Emulsion Fuel Viscosity (cp) | Conc. of Super-heavy Oil (wt %) | Average Particle Size (μm) | Coarse Particles (wt %) |
|---|---|---|---|---|---|
| 1 | Polyoxyethylene nonylphenyl ether (HLB 15.5) 0.30 wt % CMC 0.02 wt % | 2800 | 77 | 15.3 | 0.5 |
| 2 | Polyoxyethylene nonylphenyl ether (HLB 15.5) 0.30 wt % CMC 0.005 wt % | 2900 | 78 | 14.8 | 0.4 |
| 3 | Polyoxyethylene nonylphenyl ether (HLB 15.5) 0.30 wt % CMC 0.003 wt % | 2000 | 78 | 14.1 | 0.7 |
| 4 | Polyoxyethylene nonylphenyl ether (HLB 15.5) 0.30 wt % CMC 0.10 wt % | 2500 | 75 | 13.0 | 0.3 |
| 5 | Polyoxyethylene nonylphenyl ether (HLB 15.5) 0.30 wt % CMC 0.02 wt % | 2800 | 75 | 15.3 | 0.5 |

| Inventive Sample Nos. | Ionic Dispersants | Step (ii) Desired Emulsion Product Viscosity (cp) | Conc. of Super-heavy Oil (wt %) | Average Particle Size (μm) | Coarse Particles (wt %) | Stability (After Three Mons.) |
|---|---|---|---|---|---|---|
| 1 | Formalin Condensate of Sodium Naphthalenesulfonate (Degree of Condensation: 10.2) 0.05 wt % | 340 | 75 | 15.2 | 1.5 | ◎ |
| 2 | Formalin Condensate of Sodium Naphthalenesulfonate (Degree of Condensation: 10.2) 0.05 wt % | 270 | 75 | 14.7 | 0.4 | ◎ |
| 3 | Formalin Condensate of Sodium Naphthalenesulfonate (Degree of Condensation: 10.2) 0.05 wt % | 250 | 75 | 14.9 | 0.8 | ○ |
| 4 | Formalin Condensate of Sodium Naphthalenesulfonate (Degree of Condensation: 10.2) 0.05 wt % | 390 | 74 | 12.7 | 0.3 | ◎ |
| 5 | Formalin Condensate of Sodium Naphthalenesulfonate (Degree of Condensation: 10.2) 0.02 wt % | 350 | 75 | 15.3 | 0.4 | ◎ |

TABLE 2

| Inventive Sample Nos. | Surfactants and Stabilizers | Step (i) Thick Emulsion Fuel Viscosity (cp) | Conc. of Super-heavy Oil (wt %) | Average Particle Size (μm) | Coarse Particles (wt %) |
|---|---|---|---|---|---|
| 6 | Polyoxyethylene nonylphenyl ether (HLB 15.5) 0.30 wt % CMC 0.02 wt % | 2800 | 75 | 15.3 | 0.5 |
| 7 | Polyoxyethylene nonylphenyl ether (HLB 15.5) 0.30 wt % CMC 0.02 wt % | 2800 | 77 | 15.3 | 0.5 |
| 8 | Polyoxyethylene nonylphenyl ether (HLB 15.5) 0.30 wt % Xanthan gum 0.02 wt % | 2800 | 77 | 15.3 | 0.5 |
| 9 | Polyoxyethylene nonylphenyl ether (HLB 15.5) 0.30 wt % Polyvinylpyrrolidone (Molecular weight: 100000) 0.02 wt % | 2100 | 77 | 15.4 | 0.7 |
| 10 | Polyoxyethylene nonylphenyl ether (HLB 15.5) 0.30 wt % Polyvinyl Alcohol (Molecular weight: 100000) 0.02 wt % | 2200 | 77 | 15.5 | 0.8 |

| Inventive Sample Nos. | Ionic Dispersants | Step (ii) Desired Emulsion Product Viscosity (cp) | Conc. of Super-heavy Oil (wt %) | Average Particle Size (μm) | Coarse Particles (wt %) | Stability (After Three Mons.) |
|---|---|---|---|---|---|---|
| 6 | Formalin Condensate of Sodium Naphthalenesulfonate (Degree of Condensation: 10.2) 0.10 wt % | 320 | 75 | 15.5 | 0.7 | ◎ |
| 7 | Formalin Condensate of Sodium Naphthalenesulfonate (Degree of Condensation: 10.2) 0.20 wt % | 290 | 75 | 16.2 | 1.1 | ○ |
| 8 | Formalin Condensate of Sodium Naphthalenesulfonate (Degree of Condensation: 10.2) 0.05 wt % | 350 | 75 | 15.2 | 0.6 | ◎ |
| 9 | Formalin Condensate of Sodium Naphthalenesulfonate (Degree of Condensation: 10.2) 0.05 wt % | 300 | 75 | 15.3 | 0.8 | ◎ |
| 10 | Formalin Condensate of Sodium Naphthalenesulfonate | 310 | 75 | 15.6 | 0.8 | ◎ |

TABLE 2-continued

| | |
|---|---|
| | (Degree of Condensation: 10.2) 0.05 wt % |

TABLE 3

| | Step (i) | | | | |
|---|---|---|---|---|---|
| | | Thick Emulsion Fuel | | | |
| Inventive Sample Nos. | Surfactants and Stabilizers | Viscosity (cp) | Conc. of Superheavy Oil (wt %) | Average Particle Size (μm) | Coarse Particles (wt %) |
| 11 | Polyoxyethylene nonylphenyl ether (HLB 15.5) 0.30 wt % Polyvinylacrylamide (Molecular weight: 100000) 0.02 wt % | 2000 | 77 | 15.5 | 0.9 |
| 12 | Polyoxyethylene nonylphenyl ether (HLB 15.5) 0.30 wt % Montmorilonite (Average Particle Size: 1.5 μm) 0.05 wt % | 1900 | 77 | 15.7 | 1.0 |
| 13 | Polyoxyethylene nonylphenyl ether (HLB 15.5) 0.30 wt % CMC 0.02 wt % | 2800 | 77 | 15.3 | 0.5 |
| 14 | Polyoxyethylene nonylphenyl ether (HLB 15.5) 0.30 wt % CMC 0.02 wt % | 2800 | 77 | 15.3 | 0.5 |
| 15 | Polyoxyethylene nonylphenyl ether (HLB 15.5) 0.30 wt % CMC 0.02 wt % | 2800 | 77 | 15.3 | 0.5 |

| | Step (ii) | | | | | |
|---|---|---|---|---|---|---|
| | | Desired Emulsion Product | | | | |
| Inventive Sample Nos. | Ionic Dispersants | Viscosity (cp) | Conc. of Superheavy Oil (wt %) | Average Particle Size (μm) | Coarse Particles (wt %) | Stability (After Three Mons.) |
| 11 | Formalin Condensate of Sodium Naphthalenesulfonate (Degree of Condensation: 10.2) 0.05 wt % | 300 | 75 | 15.7 | 1.0 | ⊙ |
| 12 | Formalin Condensate of Sodium Naphthalenesulfonate (Degree of Condensation: 10.2) 0.05 wt % | 280 | 75 | 15.8 | 1.1 | ⊙ |
| 13 | Sodium lignin-sulfonate 0.05 wt % | 350 | 75 | 15.2 | 0.5 | ⊙ |
| 14 | Sodium polystyrene-sulfonate 0.05 wt % | 370 | 75 | 15.2 | 0.6 | ⊙ |

TABLE 3-continued

| | | | | | | |
|---|---|---|---|---|---|---|
| 15 | Sodium dodecyl benzenesulfonate 0.05 wt % | 330 | 75 | 15.3 | 0.5 | ⊙ |

TABLE 4

| | Step (i) | | | | |
|---|---|---|---|---|---|
| | | Thick Emulsion Fuel | | | |
| Inventive Sample Nos. | Surfactants and Stabilizers | Viscosity (cp) | Conc. of Superheavy Oil (wt %) | Average Particle Size (μm) | Coarse Particles (wt %) |
| 16 | Polyoxyethylene nonylphenyl ether (HLB 15.5) 0.40 wt % CMC 0.02 wt % | 2800 | 77 | 12.0 | 0.4 |
| 17 | Polyoxyethylene nonylphenyl ether (HLB 15.5) 0.80 wt % CMC 0.02 wt % | 3500 | 77 | 8.0 | 0.3 |
| 18 | Polyoxyethylene nonylphenyl ether (HLB 15.5) 0.20 wt % CMC 0.02 wt % | 2900 | 77 | 18.2 | 2.6 |
| 19 | Polyoxyethylene nonylphenyl ether (HLB 15.5) 0.10 wt % CMC 0.02 wt % | 3700 | 77 | 19.4 | 5.8 |
| 20 | Polyoxyethylene nonylphenyl ether (HLB 15.5) 0.30 wt % CMC 0.02 wt % | 2800 | 77 | 15.0 | 0.6 |

| | Step (ii) | | | | | |
|---|---|---|---|---|---|---|
| | | Desired Emulsion Product | | | | |
| Inventive Sample Nos. | Ionic Dispersants | Viscosity (cp) | Conc. of Superheavy Oil (wt %) | Average Particle Size (μm) | Coarse Particles (wt %) | Stability (After Three Mons.) |
| 16 | Formalin Condensate of Sodium Naphthalenesulfonate (Degree of Condensation: 10.2) 0.05 wt % | 350 | 75 | 12.2 | 0.14 | ⊙ |
| 17 | Formalin Condensate of Sodium Naphthalenesulfonate (Degree of Condensation: 10.2) 0.05 wt % | 950 | 75 | 8.0 | 0.3 | Δ |
| 18 | Formalin Condensate of Sodium Naphthalenesulfonate (Degree of Condensation: 10.2) 0.05 wt % | 550 | 75 | 18.4 | 2.6 | ○ |
| 19 | Formalin Condensate of Sodium Naphthalenesulfonate (Degree of Condensation: 10.2) 0.05 wt % | 720 | 75 | 19.5 | 5.9 | Δ |

TABLE 4-continued

| | | | | | | |
|---|---|---|---|---|---|---|
| 20 | Formalin Condensate of Sodium Naphthalenesulfonate (Degree of Condensation: 10.2) 0.05 wt % | 360 | 75 | 15.1 | 0.6 | ◎ |

TABLE 5

| | Step (i) | | | | |
|---|---|---|---|---|---|
| | | Thick Emulsion Fuel | | | |
| Inventive Sample Nos. | Surfactants and Stabilizers | Viscosity (cp) | Conc. of Superheavy Oil (wt %) | Average Particle Size (μm) | Coarse Particles (wt %) |
| 21 | Polyoxyethylene dodecylphenyl ether (HLB 15.5) 0.30 wt % CMC 0.02 wt % | 2700 | 77 | 14.9 | 0.5 |
| 22 | Polyoxyethylene nonylphenyl ether (HLB 15.5) 0.30 wt % CMC 0.02 wt % | 2600 | 77 | 16.6 | 2.0 |
| 23 | Polyoxyethylene nonylphenyl ether (HLB 15.5) 0.30 wt % CMC 0.02 wt % | 2700 | 77 | 15.8 | 0.9 |
| 24 | Polyoxyethylene oleyl ether (HLB 15.5) 0.30 wt % CMC 0.02 wt % | 2200 | 77 | 19.5 | 4.8 |
| 25 | Polyoxyethylene nonylphenyl ether (HLB 15.5) 0.30 wt % CMC 0.05 wt % | 2200 | 76 | 15.5 | 0.6 |

| | Step (ii) | | | | | |
|---|---|---|---|---|---|---|
| | | Desired Emulsion Product | | | | |
| Inventive Sample Nos. | Ionic Dispersants | Viscosity (cp) | Conc. of Superheavy Oil (wt %) | Average Particle Size (μm) | Coarse Particles (wt %) | Stability (After Three Mons.) |
| 21 | Formalin Condensate of Sodium Naphthalenesulfonate (Degree of Condensation: 10.2) 0.05 wt % | 340 | 75 | 15.0 | 0.6 | ◎ |
| 22 | Formalin Condensate of Sodium Naphthalenesulfonate (Degree of Condensation: 10.2) 0.05 wt % | 290 | 75 | 16.7 | 2.1 | ○ |
| 23 | Formalin Condensate of Sodium Naphthalenesulfonate (Degree of Condensation: 10.2) 0.05 wt % | 330 | 75 | 15.7 | 1.0 | ◎ |
| 24 | Formalin Condensate of Sodium Naphthalenesulfonate (Degree of Condensation: 10.2) 0.05 wt % | 280 | 75 | 13.5 | 4.9 | ○ |
| 25 | Formalin Condensate of Sodium Naphthalenesulfonate (Degree of Condensation: 10.2) 0.05 wt % | 180 | 70 | 15.6 | 0.5 | ◎ |

TABLE 6

| | Step (i) | | | | |
|---|---|---|---|---|---|
| | | Thick Emulsion Fuel | | | |
| Inventive Sample Nos. | Surfactants and Stabilizers | Viscosity (cp) | Conc. of Superheavy Oil (wt %) | Average Particle Size (μm) | Coarse Particles (wt %) |
| 26 | Polyoxyethylene nonylphenyl ether (HLB 15.5) 0.30 wt % CMC 0.05 wt % | 2300 | 79 | 16.2 | 1.3 |
| 27 | Polyoxyethylene nonylphenyl ether (HLB 15.5) 0.30 wt % CMC 0.05 wt % | 2900 | 81 | 18.4 | 2.0 |
| 28 | Polyoxyethylene nonylphenyl ether (HLB 15.5) 0.30 wt % CMC 0 wt % | 890 | 79 | 15.4 | 1.3 |
| 29 | Polyoxyethylene nonylphenyl ether (HLB 15.5) 0.30 wt % CMC 0.02 wt % | 2800 | 77 | 15.3 | 0.5 |

| | Step (ii) | | | | | |
|---|---|---|---|---|---|---|
| | | Desired Emulsion Product | | | | |
| Inventive Sample Nos. | Ionic Dispersants | Viscosity (cp) | Conc. of Superheavy Oil (wt %) | Average Particle Size (μm) | Coarse Particles (wt %) | Stability (After Three Mons.) |
| 26 | Formalin Condensate of Sodium Naphthalenesulfonate (Degree of Condensation: 10.2) 0.05 wt % | 980 | 78 | 16.2 | 1.3 | ◎ |
| 27 | Formalin Condensate of Sodium Naphthalenesulfonate (Degree of Condensation: 10.2) 0.05 wt % | 270 | 75 | 18.5 | 2.1 | ◎ |
| 28 | Formalin Condensate of Sodium Naphthalenesulfonate (Degree of Condensation: 10.2) 0.05 wt % | 210 | 75 | 15.3 | 2.8 | Δ |
| 29 | Formalin Condensate of Sodium Naphtha- | 390 | 75 | 15.3 | 1.7 | ◎ |

TABLE 6-continued

| | |
|---|---|
| | lenesulfonate (Degree of Condensation: 10.2) 0.05 wt % |

Example 2

Step (i) was carried out in the same manner as in Example 1, to give concentrated emulsion. In step (ii), water and an ionic dispersant were added to the resultant emulsion. The mixture was agitated in the same manner as in Example 1, and then the resulting mixture was blended and emulsified using a "T.K. HOMO MIXER, Model M" (manufactured by Tokushu Kika Kogyo) to produce an emulsion fuel under the agitation conditions given in Tables 7 and 8.

The resulting emulsion fuel was evaluated in the same manner as in Example 1, and the physical properties are also shown in Tables 7 and 8. Inventive Sample Nos. 30 to 35 are cases where an ionic dispersant and water are added; Inventive Sample Nos 36 to 39 are cases where only concentrated aqueous solution of at least one ionic dispersant is added without adding optional water in step (ii).

Also, in order to maintain viscosity in step (i), the procedures of step (ii) were carried out at 80° C. As for Inventive Samples 36 to 39 of Table 8, the viscosity of step (i) was measured at 80° C.

TABLE 7

| | Step (i) | | | | |
|---|---|---|---|---|---|
| | | Thick Emulsion Fuel | | | |
| Inventive Sample Nos. | Surfactants and Stabilizers | Viscosity (cp) | Conc. of Superheavy Oil (wt %) | Average Particle Size (μm) | Coarse Particles (wt %) |
| 30 | Polyoxyethylene nonylphenyl ether (HLB 15.5) 0.30 wt % CMC 0.02 wt % | 2800 | 77 | 15.3 | 0.5 |
| 31 | Polyoxyethylene nonylphenyl ether (HLB 15.5) 0.30 wt % CMC 0.02 wt % | 2800 | 77 | 15.3 | 0.5 |
| 32 | Polyoxyethylene nonylphenyl ether (HLB 15.5) 0.30 wt % CMC 0.02 wt % | 2800 | 77 | 15.3 | 0.5 |
| 33 | Polyoxyethylene nonylphenyl ether (HLB 15.5) 0.30 wt % CMC 0.02 wt % Polyoxyethylene nonylphenyl ether (HLB 15.5) 0.30 wt % CMC 0.02 wt % | 2800 | 77 | 15.3 | 0.5 |

TABLE 7-continued

| | Step (ii) | | | | | |
|---|---|---|---|---|---|---|
| | | Desired Emulsion Product | | | | |
| Inventive Sample Nos. | Ionic Dispersants | Shear Conditions of Step (ii) | Viscosity (cp) | Conc. of Superheavy Oil (wt %) | Average Particle Size (μm) | Coarse Particles (wt %) | Stability (After Three Mons.) |
| 30 | Formalin Condensate of Sodium Naphthalenesulfonate (Degree of Condensation: 10.2) 0.075 wt % | 1200/s 2 min. | 420 | 75 | 15.2 | 0.6 | ⊙ |
| 31 | Formalin Condensate of Sodium Naphthalenesulfonate (Degree of Condensation: 10.2) 0.075 wt % | 600/s 2 min. | 900 | 75 | 15.3 | 0.6 | ⊙ |
| 32 | Formalin Condensate of Sodium Naphthalenesulfonate (Degree of Condensation: 10.2) 0.075 wt % | 3000/s | 350 | 75 | 15.2 | 0.6 | ⊙ |
| 33 | Formalin Condensate of Sodium Naphthalenesulfonate (Degree of Condensation: 10.2) 0.075 wt % | 6000/s | 340 | 75 | 15.1 | 0.7 | ⊙ |
| 34 | Formalin Condensate of Sodium Naphthalenesulfonate (Degree of Condensation: 10.2) 0.075 wt % | 12000/s | 320 | 75 | 15.6 | 1.5 | ⊙ |

TABLE 8

| | Step (i) | | | | |
|---|---|---|---|---|---|
| | | Thick Emulsion Fuel | | | |
| Inventive Sample Nos. | Surfactants and Stabilizers | Viscosity (cp) | Conc. of Superheavy Oil (wt %) | Average Particle Size (μm) | Coarse Particles (wt %) |
| 35 | Polyoxyethylene nonylphenyl ether (HLB 15.0) 0.40 wt % CMC 0.01 wt % | 1500 | 78 | 15.2 | 0.3 |

TABLE 8-continued

| | | | | | |
|---|---|---|---|---|---|
| 36 | Polyoxyethylene nonylphenyl ether (HLB 15.0) 0.40 wt % CMC 0.01 wt % | 1500 | 78 | 15.2 | 0.3 |
| 37 | Polyoxyethylene nonylphenyl ether (HLB 15.0) 0.40 wt % CMC 0.01 wt % | 1900 | 79 | 15.8 | 0.4 |
| 38 | Polyoxyethylene nonylphenyl ether (HLB 15.0) 0.40 wt % CMC 0.01 wt % | 2200 | 80 | 17.5 | 1.4 |
| 39 | Polyoxyethylene nonylphenyl ether (HLB 15.0) 0.40 wt % CMC 0.01 wt % | 2200 | 80 | 17.5 | 1.4 |

| | Step (ii) | | | | | | |
|---|---|---|---|---|---|---|---|
| | | Desired Emulsion Product | | | | | |
| Inventive Sample Nos. | Ionic Dispersants | Shear Conditions of Step (ii) | Viscosity (cp) | Conc. of Superheavy Oil (wt %) | Average Particle Size (μm) | Coarse Particles (wt %) | Stability (After Three Mons.) |
| 35 | Sodium lignin-sulfonate 0.075 wt % | 1200/s 2 min. | 631 | 77 | 15.2 | 0.7 | ⊙ |
| 36 | Sodium lignin-sulfonate 0.10 wt % | 1200/s 2 min. | 433 | 77 | 15.3 | 0.3 | ⊙ |
| 37 | Sodium lignin-sulfonate 0.15 wt % | 1200/s 2 min. | 620 | 78 | 15.2 | 0.5 | ⊙ |
| 38 | Sodium lignin-sulfonate 0.20 wt % | 1200/s 2 min. | 840 | 79 | 17.4 | 1.4 | ⊙ |
| 39 | Sodium lignin-sulfonate 0.20 wt % CMC 0.005 wt % | 1200/s 2 min. | 950 | 79 | 17.6 | 1.5 | ⊙ |

Comparative Example

The same procedures as in Example 1 were carried using at least one of surfactants and stabilizers shown in Table 9, to give Comparative Samples 1 to 4.

The physical properties are evaluated in the same manner as in Example 1, and the results are also shown in Table 9. The physical properties of Comparative Sample No. 3 could not be evaluated, because no emulsion was formed in this sample.

TABLE 9

| | Step (i) | | | | |
|---|---|---|---|---|---|
| | | Thick Emulsion Fuel | | | |
| Comparative Sample Nos. | Surfactants and Stabilizers | Viscosity (cp) | Conc. of Superheavy Oil (wt %) | Average Particle Size (μm) | Coarse Particles (wt %) |
| 1 | Polyoxyethylene nonylphenyl ether (HLB 12.5) 0.30 wt % CMC 0.02 wt % | >3500 | 77 | 18.5 | 7.5 |
| 2 | Polyoxyethylene nonylphenyl ether (HLB 19.3) 0.30 wt % CMC 0.02 wt % | >3500 | 79 | 20.4 | 6.6 |
| 3 | Polyoxyethylene nonylphenyl ether (HLB 15.5) 0.05 wt % CMC 0.02 wt % | — | — | — | — |
| 4 | Polyoxyethylene nonylphenyl ether (HLB 15.5) 0.30 wt % CMC 0.02 wt % Formalin Condensate of Sodium Naphthalenesulfonate (Degree of Condensation: 10.2) 0.075 wt % | 290 | 75 | 16.1 | 6.1 |

| | Step (ii) | | | | | |
|---|---|---|---|---|---|---|
| | | Desired Emulsion Product | | | | |
| Comparative Sample Nos. | Ionic Dispersants | Viscosity (cp) | Conc. of Superheavy Oil (wt %) | Average Particle Size (μm) | Coarse Particles (wt %) | Stability (After Three Mons.) |
| 1 | Formalin Condensate of Sodium Naphthalenesulfonate (Degree of Condensation: 10.2) 0.05 wt % | 75 | >3500 | 18.5 | 7.5 | X |
| 2 | Formalin Condensate of Sodium Naphthalenesulfonate (Degree of Condensation: 10.2) 0.05 wt % | >3500 | 75 | 21.0 | 6.8 | X |
| 3 | — | — | — | — | — | — |
| 4 | — | — | — | — | — | — |

As is clear from Tables 1 to 10, when compared with the comparative samples, all of the emulsion fuels of the inventive samples prepared according to the method of the present invention have smaller amount of coarse particles and excellent flowability and long-term storage ability.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for producing a superheavy oil emulsion fuel comprising the steps of:

(i) preparing a liquid mixture comprising a superheavy oil, water, one or more nonionic surfactants having an HLB (hydrophilic-lipophilic balance) of 13 to 19, and optionally one or more stabilizers, and then agitating the resulting liquid mixture with a high shear rate of 1000/sec to 60000/sec, to give an oil-in-water (O/W) type emulsion fuel having a superheavy oil concentration of from 74 to 82% by weight, wherein said nonionic surfactants are contained in an amount of from 0.1 to 0.8% by weight of the emulsion fuel obtained in step (i), and wherein said stabilizers, when added, are contained in an amount of from 0.001 to 0.5% by weight of the emulsion fuel obtained in step (i); and (ii) adding at least one ionic dispersant, and optionally water, to the emulsion fuel obtained in step (i), and then blending and agitating the resulting liquid mixture with a shear rate of 10/sec to 10000/sec, to give an oil-in-water (O/W) type emulsion fuel having a superheavy oil concentration of from 68 to 79% by weight, wherein said at least one ionic dispersant added in step (ii) is added in an amount of from 0.01 to 0.5% by weight of the emulsion fuel obtained in step (ii).

2. The method according to claim 1, wherein said liquid mixture in step (i) further comprises at least one of anionic surfactants and cationic surfactants, wherein the weight ratio of at least one of anionic surfactants and cationic surfactants to the nonionic surfactants is from 1/100 to 1/4.

3. The method according to claim 1, wherein said stabilizers are at least one member selected from polymeric compounds and water-swellable clay minerals.

4. The method according to claim 1, wherein said oil-in-water (O/W) type emulsion fuel in step (i) has a superheavy oil concentration of from 77 to 81% by weight.

5. The method according to claim 1, wherein in the preparation of the liquid mixture in step (i), said nonionic surfactants are contained in an amount of from 0.2 to 0.4% by weight of the emulsion fuel obtained in step (i), and said stablilizers are contained in an amount of from 0.005 to 0.1% by weight of the emulsion fuel obtained in step (i); and wherein in step (ii), said dispersant is added in an amount of from 0.02 to 0.2% by weight of the emulsion fuel obtained in step (ii).

6. The method according to claim 1, wherein the weight ratio of said nonionic surfactants to said ionic dispersants, namely nonionic surfactants/ionic dispersants, is from 90/10 to 60/40 in the superheavy oil emulsion fuel obtained in step (ii).

7. The method according to claim 1, wherein the liquid mixture in step (i) is agitated with a shear rate of from 5000/sec to 20000/sec, and wherein the liquid mixture in step (ii) is agitated with a shear rate of from 100/sec to 6000/sec.

8. The method according to claim 1, wherein said oil-in-water (O/W) type emulsion fuel obtained in step (i) comprises oil droplets having a particle size distribution of which a 50%-cumulative particle size is from 3 to 30 $\mu$m, and coarse particles having particle sizes of 150 $\mu$m or more occupy 3% by weight or less in the entire oil droplets.

9. The method according to claim 1, wherein said oil-in-water (O/W) type emulsion fuel obtained in step (i) has a viscosity at 25° C. of from 400 to 3000 c.p.

10. The method according to claim 1, wherein a homomixer equipped with a high-shear turbine mixer is used in step (i) as an agitator with a high shear rate.

11. The method according to claim 1, wherein said oil-in-water (O/W) type emulsion fuel obtained in step (i) comprises oil droplets of which coarse particles having particle sizes of 150 $\mu$m or more occupy 2% by weight or less in the entire oil droplets.

12. The method according to claim 1, wherein in the preparation of the liquid mixture in step (i), at least one member selected from magnesium acetate, magnesium sulfate, magnesium nitrate, calcium acetate, calcium sulfate, calcium nitrate, iron acetate, iron sulfate, and iron nitrate is further added to said liquid mixture, in an amount of from 0.01 to 0.2% by weight of the emulsion fuel obtained in step (i).

* * * * *